United States Patent [19]

Mizobata

[11] Patent Number: 4,893,759

[45] Date of Patent: Jan. 16, 1990

[54] PAPER SHREDDER WITH CHARGE REMOVING MEANS

[75] Inventor: Takehisa Mizobata, Nara, Japan

[73] Assignee: Sharp Kabushiki Kaisha, Osaka, Japan

[21] Appl. No.: 355,121

[22] Filed: May 18, 1989

Related U.S. Application Data

[63] Continuation of Ser. No. 163,693, Mar. 3, 1988, abandoned.

[30] Foreign Application Priority Data

Mar. 5, 1987 [JP] Japan ..... 62-32777

[51] Int. Cl.[4] ..... B02C 4/28

[52] U.S. Cl. ..... 241/100; 241/225

[58] Field of Search ..... 241/100, 236, 224, 225, 241/235, 243, 36

[56] References Cited

FOREIGN PATENT DOCUMENTS 3324079 1/1985 Fed. Rep. of Germany ..... 241/100

*Primary Examiner*—Mark Rosenbaum

*Attorney, Agent, or Firm*—Flehr, Hohbach, Test, Albritton & Herbert

[57] ABSTRACT

A paper shredder having cutters for shredding sheets of paper is also provided with charge removing members such that electrostatic charges on shredded pieces of paper can be removed as these pieces drop from the cutters into a collector below.

8 Claims, 1 Drawing Sheet

PAPER SHREDDER WITH CHARGE REMOVING MEANS

This is a continuation of application Ser. No. 163,693 filed 03/03/88 now abandoned.

BACKGROUND OF THE INVENTION

This invention relates to a paper shredder and more particularly to a paper shredder provided with means for removing electrostatic charge from shredded pieces of paper.

When sheets of paper are thrown into a shredder and shredded into pieces by its cutters, the shredded pieces sometimes become positively or negatively charged by friction between themselves and attached to the interior of the shredder housing. Conventionally, a vacuum cleaner or the like is used to remove such shredded pieces attached to the interior but they are not easily removable because of their electrostatic force. In the case of a shredder provided with a paper feeder, in particular, the sheets being thrown in are rubbed against one another and the pieces shredded by such a shredder are more strongly charged than those shredded by a shredder without a paper feeder. The amount of shredded pieces which become attached is therefore greater in the case of a shredder with a paper feeder.

SUMMARY OF THE INVENTION

It is therefore an object of the present invention to eliminate the problem of paper becoming electrostatically charged as it is shredded by the cutters of a shredder such that the shredded pieces become attached to the interior of its housing.

The above and other objects of the present invention are achieved by providing a paper shredder which includes means for removing static electricity from shredded pieces produced thereby. With such charge removing means provided, a shredder embodying the present invention can reduce the amount of shredded pieces and powder of paper which fly and scatter around and become attached to the interior of the housing.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DETAILED DESCRIPTION OF THE INVENTION

Figure 1:
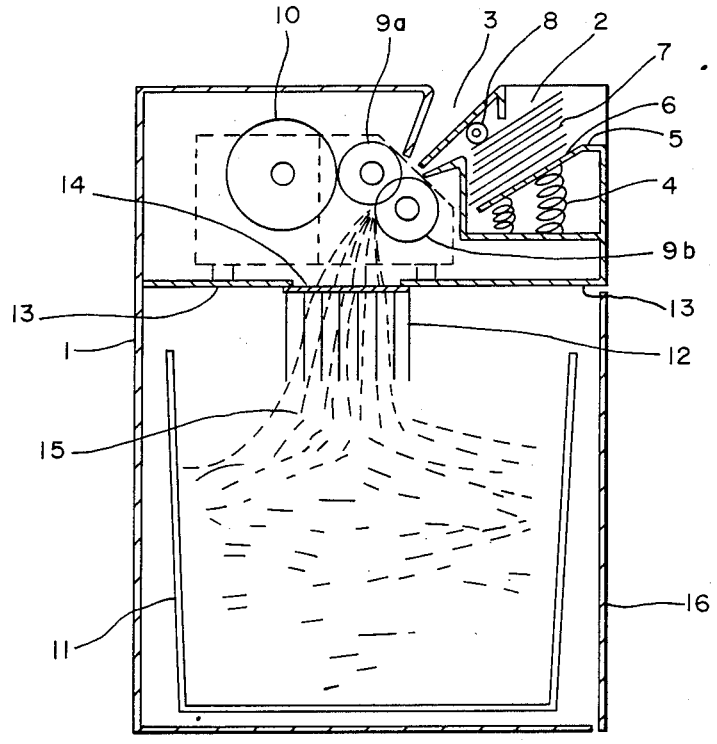
FIG. 1 is a schematic sectional view of a paper shredder embodying the present invention.

With reference to FIG. 1 showing the structure of a paper shredder embodying the present invention, numeral 1 indicates its housing having two paper feeding units. One of these paper feeding units includes an automatic paper feeder 2 which can accept a large amount of document sheets at once. The other is a manual paper feeder 3 which is used for handling the kinds of documents not processable by the automatic feeder 2 or for shredding only a small amount of paper. The automatic paper feeder 2 includes a supporting plate 6 which is supported along its edge rotatably around an axis 5 and from below by elastic members such as springs 4. Piled sheets of paper 7 to be shredded are placed on this plate 6 and when a start key or button (not shown) is operated, a feeder roller 8 begins to rotate, causing an appropriate amount of paper from the top of the pile 7 on the supporting plate 6 to be transported in the direction of a pair of cutters 6*a* and 6*b*. The cutters 9*a* and 9*b* comprise rotary blades and are driven by a driver motor 10 to shred the incoming sheets of paper. Paper which is thrown in through the manual paper feeder is similarly shredded by the cutters 9*a* and 9*b*.

Shredded pieces of paper and paper powder produced by the cutters 9*a* and 9*b* drop into a container 11 disposed therebelow inside the housing 1. According to the present invention, there is a charge removing member 12 provided on the downstream side of the cutters 9*a* and 9*b* for removing electrostatic charge from these shredded pieces of paper and paper powder as they drop into the container 11.

More in detail, a hole 14 is provided nearly at the center of a partition plate 13 which separates an upper chamber which contains the cutters 9*a* and 9*b* and a lower chamber which contains the container 11. This hole 14 is for dropping the shredded pieces of paper therethrough into the container 11 disposed therebelow. The charge removing member 12 is attached to this partition plate 13 from below at the position of this hole 14.

With a shredder thus structured, shredded pieces of paper and powder produced by the cutters 9*a* and 9*b* drop into the container 11 by passing through the hole 14 in the partition plate 13 and also through this charge removing member 12. As a result, electrostatic charge carried by these shredded pieces and paper powder is removed therefrom as they drop into the container 11. In FIG. 1, numeral 15 indicates shredded pieces of paper dropped and accumulating inside the container 11 and numeral 16 indicates a door provided to the housing 1 such that the container 11 can be removed from the interior of the housing 1 when it is full and must be emptied.

Figure 2:
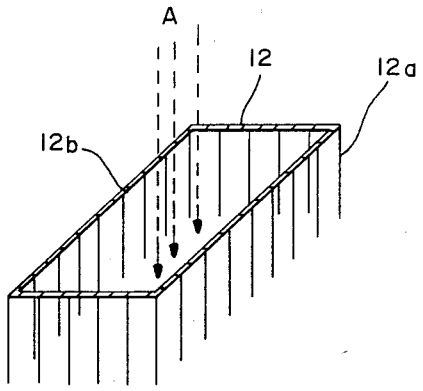
FIG. 2 is a diagonal view of a charge removing member embodying the present invention.

The charge removing member 12 is formed, as shown in FIG. 2, with a plurality of charge removing brush pieces 12*a* of a conductive or semiconductive material with about 10 cm in length and a supporting member 12*b* for supporting these brush pieces 12*a* at intervals of about 3 cm. The conductive or semiconductive material of which the brush pieces 12*a* are made has resistivity of about $10^{-6}-10^{8}$ Ωcm. These brush pieces 12*a* may be made, for example, from metallic fibers or an organic material with carbon black scattered uniformly thereon in a fiber-like manner.

Shredded pieces of paper pass through the charge removing member 12 as shown by arrows A, or substantially parallel to the direction of the brush pieces 12*a*. When positively or negatively charged pieces of shredded paper are discharged from the cutters 9*a* and 9*b*, their electric field is collected by these brush pieces 12*a* such that charges of the opposite polarity are induced on the brush pieces 12*a*. Thus, strong electric fields are generated near the brush pieces 12*a*, causing corona discharges. Of the positive and negative ions produced by such corona discharges, those of the polarity opposite to that of the shredded paper travel towards them and neutralize the charges thereon. Since a corona discharge usually takes place from a sharp point edge, charge is removed generally more effectively if the number of brush pieces 12*a* is increased. Beyond a certain limit, however, this effect cannot be improved by increasing the number of brush pieces 12*a*.

Figure 3:
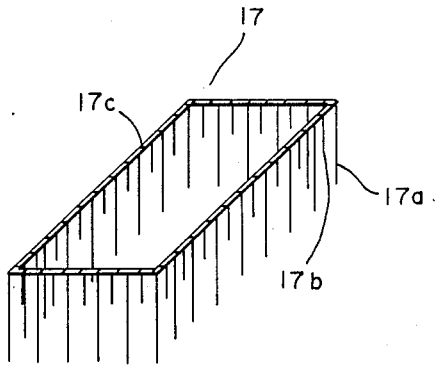
FIG. 3 is a diagonal view of another charge removing member embodying the present invention.

FIG. 3 shows another charge removing member 17 embodying the present invention. This charge removing member 17 is characterized as having brush pieces 17*a* and 17*b* of different lengths alternately affixed to a supporting member 17*c*. With a member thus structured, the area wherein the corona discharge is likely to take place is increased and hence the effect of removing charge can be improved.

The foregoing description of preferred embodiments of the invention has been presented for purposes of illustration and description. It is not intended to be exhaustive or to limit the invention to the precise form disclosed. Any modifications and variations that may be apparent to a person skilled in the art are intended to be included within the scope of this invention.

What is claimed is:

1. In a paper shredder having paper shredding means and a receptacle means below said paper shredding means for receiving and storing pieces shredded by said paper shredding means, the improvement wherein said shredder further comprises charge removing means disposed below said paper shredding means and above said receptacle means for removing static electricity from pieces shredded by said paper shredding means before said shredded pieces contact said receptacle means.

2. The paper shredder of claim 1 further comprising a paper feeder for transporting paper to be shredded to said shredder means.

3. The shredder of claim 1 wherein said charge removing means is made from metallic fibers.

4. The shredder of claim 1 wherein said charge removing means is made from an organic material with carbon black scattered uniformly thereon.

5. In a paper shredder having paper shredding means and a receptacle means for receiving and storing pieces shredded by said paper shredding means, the improvement wherein said shredder further comprises charge removing means disposed between said paper shredding means and said receptacle means for removing static electricity from pieces shredded by said paper shredding means and wherein said charge removing means include a plurality of elongated semiconductive or conductive pieces of resistivity between $10^{-6}$ and $10^{8}$ Ωcm supported substantially vertically.

6. The shredder of claim 5 wherein said elongated semiconductive or conductive pieces are mutually separated by about 3 cm.

7. The shredder of claim 5 wherein said semiconductive or conductive pieces are about 10 cm in length.

8. The shredder of claim 5 wherein said semiconductive or conductive pieces include longer pieces and shorter pieces which are disposed alternately.

* * * * *